US007950207B2

(12) United States Patent
Maisel

(10) Patent No.: US 7,950,207 B2
(45) Date of Patent: May 31, 2011

(54) PACKAGING MACHINE

(75) Inventor: Matthias Maisel, Wiggensbach (DE)

(73) Assignee: Multivac Sepp Haggenmueller GmbH & Co. KG (DE)

( * ) Notice: Subject to any disclaimer, the term of this patent is extended or adjusted under 35 U.S.C. 154(b) by 229 days.

(21) Appl. No.: 12/003,314

(22) Filed: Dec. 21, 2007

(65) Prior Publication Data

US 2008/0152767 A1 Jun. 26, 2008

(30) Foreign Application Priority Data

Dec. 22, 2006 (DE) ..... 10 2006 062 143
Mar. 19, 2007 (DE) ..... 10 2007 013 698

(51) Int. Cl.
*B65B 31/02* (2006.01)

(52) U.S. Cl. ..... 53/510; 53/403; 53/432; 53/111 R

(58) Field of Classification Search ..... 53/403, 53/432–434, 510–512, 111 R
See application file for complete search history.

(56) References Cited

U.S. PATENT DOCUMENTS

| | | | | |
|---|---|---|---|---|
| 4,212,891 | A * | 7/1980 | Fujita et al. | 426/231 |
| 4,685,274 | A | 8/1987 | Garwood | |
| 4,842,875 | A * | 6/1989 | Anderson | 426/118 |
| 5,798,694 | A * | 8/1998 | Reber et al. | 340/540 |
| 5,822,951 | A | 10/1998 | Rosik | |
| 5,832,699 | A | 11/1998 | Zobel | |
| 6,013,293 | A * | 1/2000 | De Moor | 426/106 |
| 6,441,340 | B1 | 8/2002 | Varriano-Marston | |
| 2002/0043050 | A1 | 4/2002 | Costello et al. | |
| 2003/0029850 | A1 | 2/2003 | Varriano-Marston | |
| 2003/0172627 | A1 | 9/2003 | Backus | |
| 2003/0182900 | A1 | 10/2003 | Bowden et al. | |
| 2006/0213153 | A1 * | 9/2006 | Sanfilippo et al. | 53/511 |

FOREIGN PATENT DOCUMENTS

| | | | |
|---|---|---|---|
| AT | 298 212 | B | 4/1972 |
| DE | 601 08 381 | T2 | 4/2006 |
| EP | 1 378 450 | A1 | 1/2004 |
| EP | 1 194 350 | B1 | 2/2005 |
| EP | 1 647 489 | A2 | 4/2006 |
| EP | 1 714 885 | A | 10/2006 |
| EP | 1 714 885 | A1 | 10/2006 |
| WO | WO 2006/086827 | A | 8/2006 |

* cited by examiner

*Primary Examiner* — Hemant M Desai
(74) *Attorney, Agent, or Firm* — Brooks Kushman P.C.

(57) ABSTRACT

A packaging machine for producing packs from packagings filled with items, by means of which the shelf life of items that need to breathe can be improved is proposed. This is achieved according to the invention by means for influencing the atmosphere in the space inside the packs (26) in a way dependent on the breathing rate of the item (4).

22 Claims, 1 Drawing Sheet

PACKAGING MACHINE

TECHNICAL FIELD

The invention relates to a packaging machine for producing packs from packagings filled with items.

BACKGROUND

For producing packs by packing items in packagings, there are already commercially available machines in which, for example, recessed packagings filled with items are closed and sealed with a top sheet. In this way, vacuum packs or packs with an inert gas filling can be created.

When packaging certain items of food, for example cheese, fruit and vegetables such as asparagus or lettuce and other items of food or similar products that need to breathe, closed packagings have the disadvantage that gases are produced in the pack during the maturing or ripening process, in particular ethylene and carbon dioxide, and these have an adverse effect on the shelf life. Ethylene in particular speeds up the maturing or ripening process and then shortens the shelf life. One of the effects of carbon dioxide is to cause undesired fermentation processes, and is consequently also detrimental to the shelf life. For such items to have a good shelf life, an atmosphere that is adapted to the product to be packed is desirable, for example in the case of certain items of food an oxygen content that remains as constant as possible in the atmosphere inside the packs, for example at approximately 5%, while undesired gases such as carbon dioxide and ethylene are removed. For this purpose, a change has taken place in favor of using appropriately perforated films or sheets. The top sheets concerned can usually be obtained by the operator of the packaging machine in rolls from film and sheet suppliers.

In the document DE 10 2006 017 887.4, which is not a prior publication, a description is also given of a packaging machine in which a perforating unit is provided for perforating the top sheet. As a result, the same sheet that is used for tightly closing the packs can be used for packs with a selectively permeable top membrane.

SUMMARY

On the basis of such a device, the object of the invention is to propose a packaging machine by means of which the shelf life of items that need to breathe can be improved.

Accordingly, a packaging machine according to the invention is distinguished by the fact that means for influencing the atmosphere in the pack in a way dependent on the breathing rate of the item are provided. Such a measure allows the shelf life of an item that needs to breathe, for example an item of food such as vegetables, fruit or the like, to be extended.

The influencing of the atmosphere in the pack can be performed, for example, by supplying and/or removing one or more gases in a way dependent on the breathing rate of the respective product. Another possible way of influencing the atmosphere in the pack is to make the pack entirely or partially gas-permeable. Such measures allow the removal of gases produced in the pack by breathing of the item and/or the supply of atmospheric ambient air into the pack to be brought about. For example, the removal of $CO_2$ and/or ethylene by diffusion through an appropriately permeable area of the pack allows a longer shelf life of corresponding products such as vegetables or fruit to be achieved. Such a process can be assisted by supplying oxygen from the air, for example likewise by diffusion from the surroundings.

The breathing rate of the item to be packed may in this case be entered manually into a control unit of the packaging machine. A variant in which breathing rates are stored in a data memory in such a way that they are assigned to respective products is also conceivable. It is particularly advantageous that, in addition to this, the type of perforation can also be stored.

In the case of these variants, the atmosphere in the packs to be packed is always influenced according to the predetermined breathing rate.

In a particularly advantageous configurational variant, the packaging machine comprises means for sensing the breathing rate of the item to be packed. In this way, it can be ensured that the value of the breathing rate that is used for setting the atmosphere in the pack corresponds to the greatest extent to the actual breathing rate of the item to be packed. In this case it is also possible for the breathing rate to be sensed in the manner of taking random samples during the operation of the packaging machine, so that an adaptation to the breathing rate of the item filled into the packs always takes place in intermittent steps in which a renewed random sample is measured after the packing of a certain number of packs.

However, the individual determination of the breathing rate of the item in each individual pack or group of packs is particularly advantageous. Such a group of packs may, for example, comprise a number of packs processed together in one operating cycle. In the integration of the corresponding means for sensing the breathing rate in the operating sequence of the packaging machine, such an individual adaptation of the pack or a group of packs or influencing of the internal atmosphere of the packs or groups of packs is possible.

The sensing of the breathing rate of the product to be packed may in this case be performed by the packaging machine itself during the packing. In a more simple configurational variant, the measuring of the breathing rate is also performed outside the packaging machine and/or at a point in time other than that when the packaging operation takes place. The measurement may in this case also take place in the manner of random samples on the finished packs. The crucial point, however, in the case of a packaging machine according to the invention is that the machine control is capable of using the corresponding measurement results in such a way that the internal atmosphere of the packs can be influenced such that it is adapted to the measurement results. Consequently, the breathing rate measured on previously completed packs can serve the purpose of advantageously influencing the internal atmosphere of packs to be produced later.

With a measurement of the breathing rate already carried out in advance, it is even possible for each individual item that is to be packed to use the sensed value directly for manipulating the pack that is subsequently to be produced or completed precisely for this product. As a result, it is possible to have an optimum influence on the internal atmosphere.

In the case of a packaging machine according to the invention, at least one gas sensor is preferably provided for the sensing of the breathing rate. Such gas sensors are commercially available, for example, for measuring the concentration of $CO_2$ and also for other gases. In principle, all future developments of gas sensors can also be used for this purpose for the invention. According to the invention, a gas sensor is understood as meaning any sensor that is suitable for detecting or sensing an amount of gas and/or a concentration of gas, for example also an infrared sensor, a spectrometer or the like.

In order not only to determine the amount or concentration of a gas in the pack or group of packs or in the immediate surroundings of the pack or group of packs, for example over one or more packaging trays or recesses, but also the breathing rate of the product located in it with respect to the gas sensed, a time-dependent measurement is advantageously carried out, and the change in the concentration of gas sensed with it is used as a measure of the breathing rate.

For this purpose, it is preferred to construct a measuring station upstream of the sealing station in the packaging machine. This allows the measurement result from the measuring station to be used for determining the breathing rate in order to have the desired influence on the internal atmosphere of the pack or group of packs before or during the sealing of the packs.

For the influencing of the atmosphere according to the invention, various measures are possible. For example, a top sheet for closing one or more trays or recesses in the pack may be individually adapted in a way corresponding to the sensed measured value of the item before the sealing of the pack or group of packs, for example by perforations or other measures for influencing the permeability, such as for example locations where the material is weakened by removing or stretching it or the like. Other areas, for example trays or recesses of a bottom sheet, may also be correspondingly worked, for example perforated. A supply of gas, which in the case of known machines takes place in the sealing station, may be metered and controlled with allowance for the measured value sensed in the upstream measuring station.

In principle, it is also conceivable to have an influence on the pack after the sealing, in that the gas permeability of the packs is changed after the sealing.

As already indicated above, means which create a selective permeability of at least part of the pack are advantageously provided for influencing the internal atmosphere of the pack. Such selective permeability is possible, for example, by perforations, it being possible to use the number, size and form of the perforation to produce the selectivity. Another possible way of making a pack at least partially selectively permeable is, for example, that of entirely or partially stretching the top sheet and/or other areas of the pack in order to produce an area of selective permeability. If appropriate, weakened material zones may be stabilized by reinforcing means, such as coverings of netting or the like. A corresponding measure is conceivable, for example, by removing material, making it begin to melt or measures of this kind. In another embodiment, parts of the pack may also be provided with openings that are subsequently closed again with correspondingly permeable materials.

The use of perforating means thereby offers various advantages. On the one hand, as stated above, the permeability can be influenced with regard to the amount and with regard to the selectivity by selecting the number or the form of the perforations. In addition, perforating means can be easily integrated in a packaging machine, for example in the area of a top sheet and/or in the area of a bottom sheet. In this case, a formed or unformed sheet may be correspondingly worked. Mechanical perforating means, perforating means with liquid jet nozzles, for example water jet nozzles, and/or perforating means assisted by lasers or the like come into consideration for example.

With preference, the corresponding parts of the packaging that are used for influencing the internal atmosphere of the packs are appropriately prepared in an area of the machine that is away from the item and are only added to the pack subsequently. In the case of roll-fed or thermoforming machines or tray sealing machines, it is possible for example for the top sheet and/or the bottom sheet to be appropriately worked before it is fed to the sealing station.

Such a spatial separation avoids contaminants that may be caused by working of the pack, for example in the form of vapor, getting into the area of the item. In principle, the working of the sheets may, however, also only take place during or after the sealing.

A measuring station for sensing the breathing rate may be constructed in various ways. In order to obtain the pack-specific measurement result, in one particular embodiment a measuring chamber may be provided for receiving the pack that is to be measured, closing it from the surroundings and then sensing an amount of gas and/or a concentration of gas over a certain time by means of a sensor suitable for sensing an amount of gas and/or a concentration of gas. If the sensing of individual measured values to be assigned to each individual pack is not desired, a certain number of such packs, for example in the case of a roll-fed or thermoforming machine, a number of packs joined together in one or more rows, may also be brought into such a measuring chamber as a group of packs. In this case, in the measurement of the breathing rate, this rate is averaged over the packs that are in the measuring chamber.

The invention may be meaningfully applied to different types of packs. For example, packs known as tray packs, in which products are placed in a pre-formed bottom sheet in the form of a tray and subsequently sealed with a top sheet, come into consideration. According to the invention, however, packaging bags or packs in which one or more sheets are stretched over the product, may also be correspondingly processed according to the invention. Such packs are, for example, known by the term "flow pack".

As already mentioned, the influencing of the internal atmosphere is possible, for example, by perforating packaging sheets. Such perforations may be performed in various areas of the pack, for example in the case of tray packs in the top sheet, but also at any other desired locations. Suitable arrangement of such perforations allows better distribution of the gas permeability of the pack, and consequently a good distribution of the gas to be supplied and/or removed, to be achieved within the pack.

It is preferred to form the packaging machine according to the invention as what is known as a thermoforming or roll-fed machine or else as what is known as a tray sealing machine (tray sealer). In the case of such packaging machines, the packs are formed from recessed trays in which the item is placed and which are subsequently closed with a top sheet. In the case of a tray sealing machine, individual trays, for example taken from a stack, are used here. In the case of a roll-fed or thermoforming machine, a certain number of joined-together packagings are formed or thermoformed in a forming station, transported further in a joined-together state in time with the machine cycle, sealed and only cut into individual packs after the sealing.

In the case of machines of this type, an evacuation and supply of gas into the pack is already possible in the sealing station according to the prior art. In combination with the invention, a measuring station for sensing the breathing rate is now preferably arranged upstream of such machines. Depending on the configuration, an evacuation and supply of gas to the packs may take place in the sealing station.

If, in the case of such a machine, a certain gas permeability of the pack is desired, the top sheet is advantageously worked correspondingly, for example perforated, before the sealing of the pack. This may be performed in the case of such machines well away from the item, since the top sheet is generally drawn off from a supply roll mounted away from it and an appropriate perforating unit can be arranged without any problem between the supply roll and the sealing station.

A particularly advantageous embodiment of the invention is obtained if not only the measured breathing rate of the item is used for influencing the internal atmosphere, for example for designing a gas-permeable pack, but at the same time allowance is made for specific parameters of the type of storage intended for the packs produced. Such storage parameters may be provided by the ambient conditions at the storage site, for example the temperature, atmospheric humidity or the like. In addition, allowance may also be made for other product-specific parameters, for instance the surface, the degree of maturity or ripening, the pretreatment and/or other information when determining how an influence is brought to bear on the internal atmosphere of the packs. If appropriate, product-dependent values, such as degree of maturity or ripening, surface or the like, may also be determined in the measuring station for sensing the breathing rate.

With respect to one particular embodiment, a complete olfactometric measurement is accommodated in such a measuring station.

This allowance for product properties or the storage conditions at the site of the intended storage is preferably performed by a computational correction of the measured value of the breathing rate in a corresponding control unit.

An exemplary embodiment of the invention is represented in the drawing and is explained in more detail below on the basis of the FIGURE.

DETAILED DESCRIPTION

Figure 1:
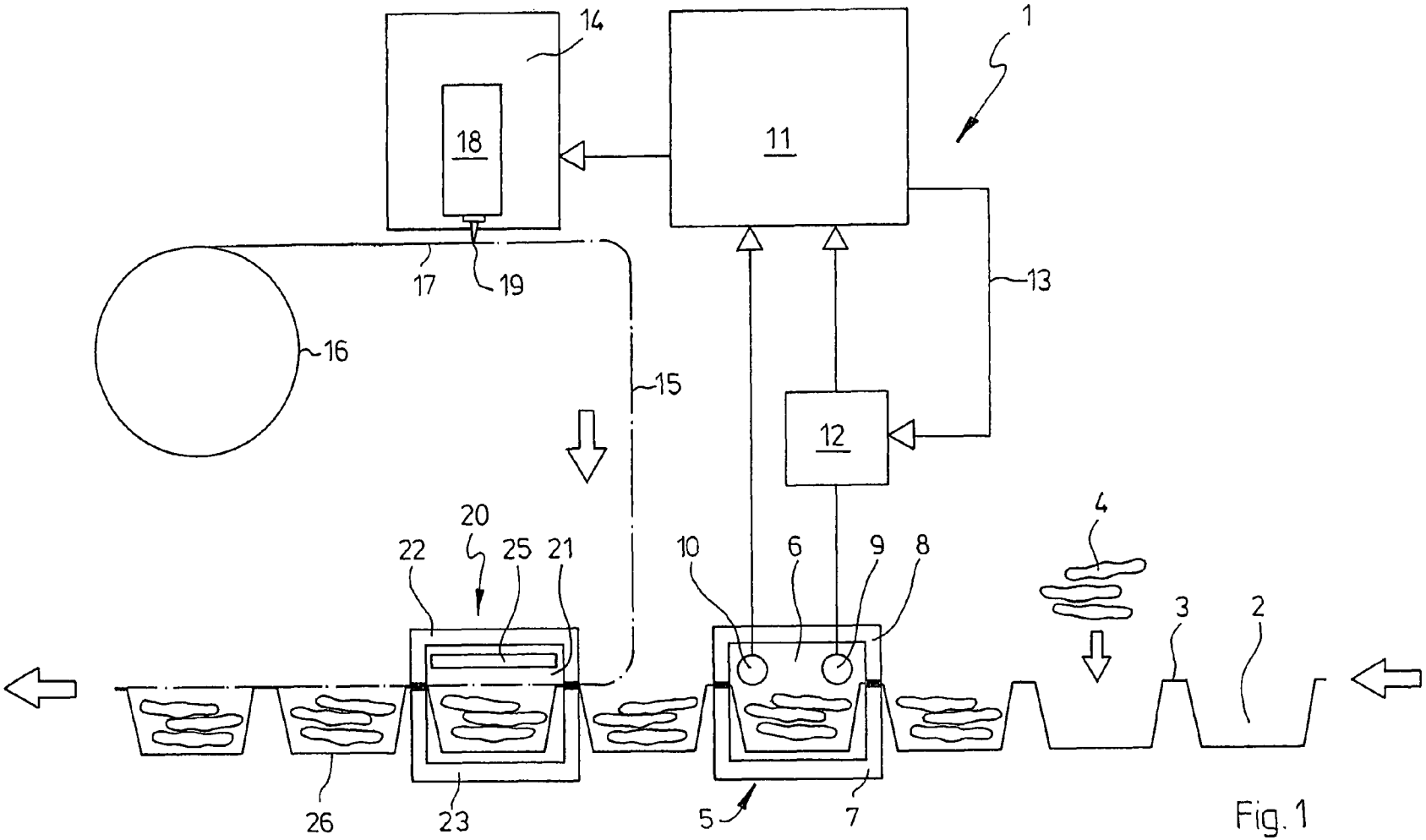
FIG. 1 shows a schematic representation of a packaging machine according to the invention.

FIG. 1 shows what is known as a roll-fed or thermoforming machine in a schematic diagram, represented in the form of a detail.

Pack recesses 2, which have been formed into a bottom sheet 3 by a forming station (not represented in any more detail) are filled with items 4. The item 4 may be a product that needs to breathe, for example vegetables or fruit. In a measuring station 5, the filled pack recesses 2 are isolated from the outer surroundings in a measuring chamber 6. In the exemplary embodiment represented, the measuring chamber 6 comprises a lower part 7 and an upper part 8. One or both of the parts 7, 8 may be arranged such that it/they is/are movable up or down, so that they can be opened for transporting the respective pack recesses 2 in and away.

Two schematically indicated sensors 9, 10 are represented in the measuring station 5 or the measuring chamber 6. The sensor 10 is in this case a sensor which can directly generate a usable signal and feed it to a control unit 11 of the packaging machine 1. The sensor 9, on the other hand, needs a sensor control and/or evaluation unit 12 of its own to generate measurement results that can be further processed for the control unit 11. In the embodiment represented there is a feedback line 13 between the control unit 11 and the sensor control and/or evaluation unit 12, by which closed-loop control of the measurement can be carried out if need be.

The sensor 9 may be, for example, a gas sensor, in particular a $CO_2$ sensor. Such sensors are commonly available on the market with their own sensor control and/or evaluation units.

The sensor 10 may be, for example, a temperature sensor. Other sensors, for example for measuring the humidity or for sensing another gas, may most certainly be likewise provided.

The gas sensor 9 is used for determining the breathing rate. For this purpose, it is necessary to perform the gas measurement time-dependently, or to sense a change in the concentration of the gas (gradient measurement). This type of measurement may be monitored, for example, by the sensor control and/or evaluation unit 12, so that a definitive measured value for the breathing rate is already transferred to the control unit 11. In another embodiment, however, the control unit may also control the time-dependent measurement on an open-loop or a closed-loop basis.

The sensing of other parameters, such as for example temperature, humidity, surface of the products, etc., may be used for improving the shelf life. In particular, such additional measured values may be used to perform a comparison of the ambient conditions at the site of the packaging machine with the likely storage site. In a highly developed embodiment of the invention, the control unit 11 may make allowance for all the measured values that are sensed, as well as possibly information that is additionally made available with regard to the storage site or the type of storage (it also being possible for the transportation of the product to be regarded as storage), to influence the internal atmosphere of the packs, for example to activate a perforating unit 14.

The perforating unit 14 makes perforations 15 in a top sheet 17, which is drawn off from a supply roll 16.

In the present case, a laser 18 with a focused laser beam 19 is indicated, but other possible ways of influencing the permeability of the top sheet, and in particular of making perforations 15, may also be taken into consideration. For example, a mechanical perforation would also be conceivable. In this case, for example, the size of the perforations could be changed by means of the depth of penetration of perforating needles, etc.

The perforations 15 are adapted, not only with regard to their size and number but also their form, to the desired gas exchange between the internal atmosphere of the packs and the outer surroundings. In a sealing station 20, which comprises a sealing chamber 21 comprising an upper part 22 and a lower part 23, the top sheet 17 is joined or welded to the bottom sheet 3 or pack recesses 2 by means of a sealing plate 25. The sealing chamber 21, or its upper part 22 and lower part 23, are formed such that they are movable, preferably movable up or down, for the purpose of supplying and removing the packs 26 formed from the bottom sheet 3 and top sheet 17, so that the sealing chamber 21 can be opened and closed.

In the sealing chamber 21, an evacuation and supply of gas into the packs that is dependent on the measurement of the measuring station can be performed.

The finished packs 26 are then fed to a cutting station (not represented in any more detail), which separates the still joined-together packs 26 into individual packs.

The embodiment represented only represents an example of how the invention is realized. The gas permeability of the packs 26 may also be influenced in some other way than by perforating a top sheet. For example, tightly closed packs 26 may also be influenced with regard to their internal atmosphere by supplying gas in the sealing station 20. Combinations of supplying gas and creating gas permeabilities, in particular selective gas permeabilities, may also be used according to the invention for increasing the shelf life of the packed item 6.

LIST OF DESIGNATIONS

1 roll-fed or thermoforming machine
2 pack recess
3 bottom sheet
4 item
5 measuring station

6 measuring chamber
7 lower part
8 upper part
9 sensor
10 sensor
11 control unit
12 sensor control and/or evaluation unit
13 feedback line
14 perforating unit
15 perforation
16 supply roll
17 top film
18 laser
19 laser beam
20 sealing station
21 sealing chamber
22 upper part
23 lower part
24 sealing plate
25 sealing plate
26 pack

The invention claimed is:

1. A packaging machine for producing packs from packagings filled with items, the packaging machine comprising:
means for sensing breathing rate of at least one of the items;
means for influencing atmosphere inside the packs in a way dependent on the breathing rate; and
a sealing station for sealing the packs;
wherein the means for sensing breathing rate comprises a measuring station for sensing the breathing rate arranged upstream of the sealing station, the measuring station including an openable and closable chamber that receives, at one time, multiple unsealed packs that are filled with items, and a sensor disposed in the chamber, and wherein the breathing rate is determined as an average breathing rate.

2. The packaging machine as claimed in claim 1, wherein the means for influencing atmosphere includes means for creating a gas permeability of at least part of each pack in dependence on the breathing rate.

3. The packaging machine as claimed in one of the preceding claims, wherein the means for influencing atmosphere includes means for metering one or more gases to be supplied inside each pack in dependence on the breathing rate.

4. The packaging machine as claimed in claim 1, wherein the means for influencing atmosphere comprises a perforating unit for forming perforations in a film or sheet, and the sealing station is configured to perform a sealing operation on the film or sheet to form the packs, and wherein the perforating unit is configured to form the perforations before, during or after the sealing operation.

5. The packaging machine as claimed in claim 1, wherein the means for sensing breathing rate includes at least one gas sensor.

6. The packaging machine as claimed in claim 1, wherein the means for influencing atmosphere includes means for creating a selective permeability of at least part of each pack.

7. The packaging machine as claimed in claim 1, wherein the means for influencing atmosphere includes perforating means for producing a perforation in at least part of each pack.

8. The packaging machine as claimed in claim 1, wherein the means for influencing atmosphere includes means for setting gas permeability of at least part of each pack.

9. The packaging machine as claimed in claim 1, wherein the means for influencing atmosphere includes a perforating unit for forming perforations in the packs and means for setting number and/or size and/or form of the perforations.

10. The packaging machine as claimed in claim 1, wherein the packaging machine is formed as a thermoforming and/or tray sealing machine.

11. The packaging machine as claimed in claim 1, wherein the sensor comprises a gas sensor for sensing $O_2$ and/or $CO_2$ and/or ethylene breathing rate.

12. The packaging machine as claimed in claim 1, wherein the means for influencing atmosphere comprises a control unit for making allowance for product-specific parameters and/or parameters dependent on storage site and/or type of storage for the packs.

13. The packaging machine as claimed in claim 1 further comprising a control unit for making a computational correction of the sensed breathing rate for adaptation to other product-specific parameters or to storage conditions intended for the at least one item.

14. The packaging machine of claim 1 further comprising a filling station for filling items into pack recesses formed in a bottom sheet, and a perforating unit for perforating a packaging sheet, wherein the sealing station is arranged for sealing the packaging sheet onto the bottom sheet to form the packs, and wherein the perforating unit perforates the packaging sheet in a manner dependent on the breathing rate.

15. The packaging machine of claim 1 wherein the means for sensing includes an openable and closable chamber that receives one or more unsealed packs.

16. The packaging machine of claim 1 wherein the means for influencing atmosphere includes a meter for metering, in dependence on the breathing rate, one or more gases to be supplied inside each pack while the pack is disposed in the sealing station.

17. A packaging machine for producing packs that are each filled with an item, the packaging machine comprising:
a measuring station for measuring breathing rate of one or more of the items in one or more unsealed packs, the measuring station including an openable and closable chamber that receives, at one time, multiple unsealed packs that are filled with items, and a sensor disposed in the chamber, wherein the breathing rate is determined as an average breathing rate;
an additional station associated with the measuring station for influencing atmosphere inside each pack in a way dependent on the breathing rate; and
a sealing device arranged downstream of the measuring station for sealing the unsealed packs to form the packs.

18. The packaging machine of claim 17 wherein the additional station comprises a perforating unit for perforating a part of each pack based on the breathing rate.

19. The packaging machine of claim 17 further comprising a filling station disposed upstream of the measuring station for filling items into recesses formed in a first sheet, wherein the additional station comprises a perforating unit for perforating a second sheet based on the measured breathing rate, and wherein the sealing device is configured to seal the first and second sheets together to form the packs.

20. The packaging machine of claim 17 wherein the additional station comprises the sealing device.

21. The packaging machine of claim 17 wherein the sensor is disposed outside of the one or more unsealed packs when the one or more unsealed packs are received in the chamber.

22. The packaging machine of claim 17 wherein the sensor comprises a gas sensor for sensing $O_2$ and/or $CO_2$ and/or ethylene breathing rate.

* * * * *